US011643992B2

(12) United States Patent
Miyanaga

(10) Patent No.: US 11,643,992 B2
(45) Date of Patent: May 9, 2023

(54) PLASTIC MOLDED ARTICLE

(71) Applicant: TOYOTA BOSHOKU KABUSHIKI KAISHA, Aichi-ken (JP)

(72) Inventor: Naritsune Miyanaga, Toyota (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 57 days.

(21) Appl. No.: 17/374,221

(22) Filed: Jul. 13, 2021

(65) Prior Publication Data

US 2022/0018308 A1 Jan. 20, 2022

(30) Foreign Application Priority Data

Jul. 17, 2020 (JP) ..... JP2020-122990

(51) Int. Cl.
*F02F 7/00* (2006.01)
*F02B 77/00* (2006.01)
*F01M 13/04* (2006.01)

(52) U.S. Cl.
CPC ..... *F02F 7/006* (2013.01); *F02B 77/00* (2013.01); *F01M 13/04* (2013.01)

(58) Field of Classification Search
CPC .. F02F 7/006; F02F 2007/0063; F02F 7/0082; F02F 7/0095; F02B 77/00; F01M 13/04; F01M 2013/005
See application file for complete search history.

(56) References Cited

U.S. PATENT DOCUMENTS 9,453,441 B2 * 9/2016 Kontani ..... F02M 25/06
11,015,501 B2 * 5/2021 Kimpara ..... F02B 61/045
2003/0070982 A1 * 4/2003 Baek ..... F02M 25/06 210/512.1
2014/0238331 A1 * 8/2014 Saito ..... F02F 7/006 123/193.5

FOREIGN PATENT DOCUMENTS

JP 2014-122601 A 7/2014

* cited by examiner

*Primary Examiner* — Syed O Hasan
(74) *Attorney, Agent, or Firm* — Greenblum & Bernstein, P.L.C.

(57) ABSTRACT

A plastic molded article includes a base having a main surface, a first tubular portion protruding from the main surface, a second tubular portion protruding from the main surface and having an inner diameter smaller than that of the first tubular portion, and a pair of ribs that protrudes from the main surface and connects an outer circumferential surface of the first tubular portion and an outer circumferential surface of the second tubular portion to each other. The base, the first tubular portion, the second tubular portion, and the ribs are integrally molded of plastic. The ribs are located on opposite sides of an imaginary plane that includes a central axis of the first tubular portion and a central axis of the second tubular portion.

7 Claims, 2 Drawing Sheets

PLASTIC MOLDED ARTICLE

BACKGROUND

1. Field

The present disclosure relates to a plastic molded article that includes a base having a main surface, a first tubular portion protruding from the main surface, and a second tubular portion protruding from the main surface and having an inner diameter smaller than that of the first tubular portion. The base, the first tubular portion, and the second tubular portion are integrally molded of plastic.

2. Description of Related Art

One example of such plastic molded articles is a cylinder head cover for an internal combustion engine (for example, refer to Japanese Laid-Open Patent Publication No. 2014-122601). The cylinder head cover disclosed in the publication includes a plug cylinder, into which an insertion portion of an ignition coil is inserted, and a receiving portion, in which a nut is embedded by insert molding. The plug cylinder and the receiving portion are integrally molded of plastic. A bolt for fixing the ignition coil to the cylinder head cover is threaded into the nut.

When such a plastic cylinder head cover is molded, molding shrinkage occurs. In the case of the cylinder head cover of the above-described publication, the plug cylinder and the receiving portion shrink toward the respective central axes. The inner diameter of the plug cylinder is larger than the inner diameter of the receiving portion. Accordingly, the receiving portion is pulled toward the plug cylinder due to the molding shrinkage of the plug cylinder. This may displace the receiving portion, that is, the nut, from the proper position. As a result, after the insertion portion of the ignition coil is inserted into the plug cylinder, it may be impossible to thread the bolt into the nut in the receiving portion.

The above-described drawbacks are not limited to plastic cylinder head covers, but may also be found in any plastic molded article that includes a base having a main surface, a first tubular portion protruding from the main surface, and a second tubular portion protruding from the main surface and having an inner diameter smaller than that of the first cylinder, and in which the base, the first tubular portion, and the second tubular portion are integrally molded of plastic.

SUMMARY

Accordingly, it is an objective of the present disclosure to provide a plastic molded article that improves dimensional accuracy in a favorable manner.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a plastic molded article includes a base having a main surface, a first tubular portion protruding from the main surface, a second tubular portion, and a pair of ribs. The second tubular portion protrudes from the main surface and has an inner diameter smaller than that of the first tubular portion. The ribs protrude from the main surface and connect an outer circumferential surface of the first tubular portion and an outer circumferential surface of the second tubular portion to each other. The base, the first tubular portion, the second tubular portion, and the ribs are integrally molded of plastic. The ribs are located on opposite sides of an imaginary plane that includes a central axis of the first tubular portion and a central axis of the second tubular portion.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A plastic molded article according to one embodiment will now be described with reference to FIGS. 1 to 4. In the present embodiment, the plastic molded article of the present disclosure is a cylinder head cover 10 configured to be attached to the cylinder head of an in-line four cylinder internal combustion engine.

Figure 1:
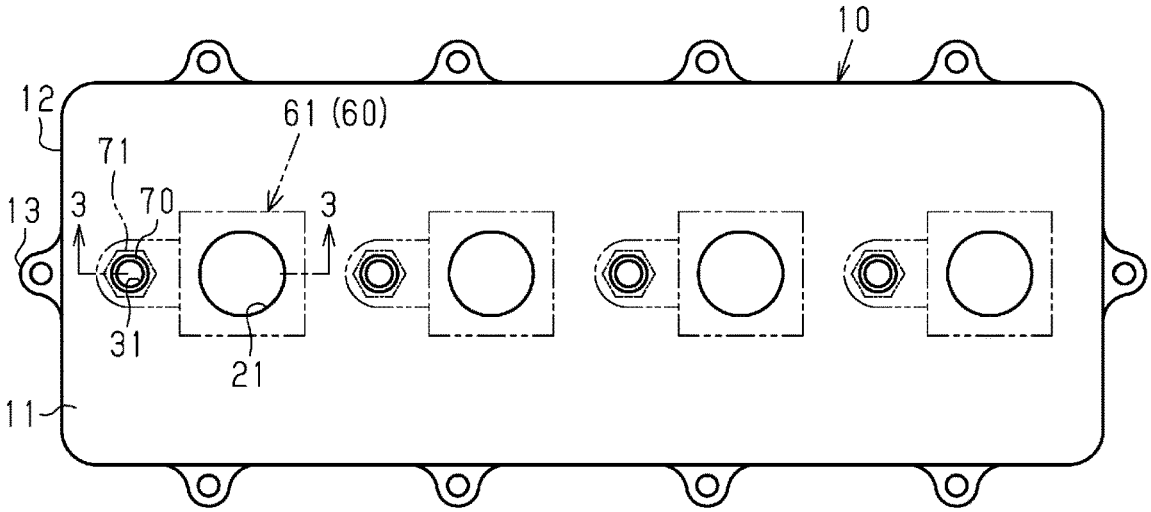
FIG. 1 is a plan view of a plastic molded article according to one embodiment, illustrating a cylinder head cover for an internal combustion engine.

As shown in FIG. 1, the cylinder head cover 10 includes a top wall 11, which is rectangular in a plan view, and a peripheral wall 12, which is provided at the periphery of the top wall 11. The top wall 11 and the peripheral wall 12 are integrally molded of plastic. The top wall 11 corresponds to the base according to the present disclosure. The peripheral wall 12 includes attachment portions 13 at the outer peripheral edge. The attachment portions 13 receive bolts for attaching the cylinder head cover 10 to a cylinder head (not shown).

Figure 2:
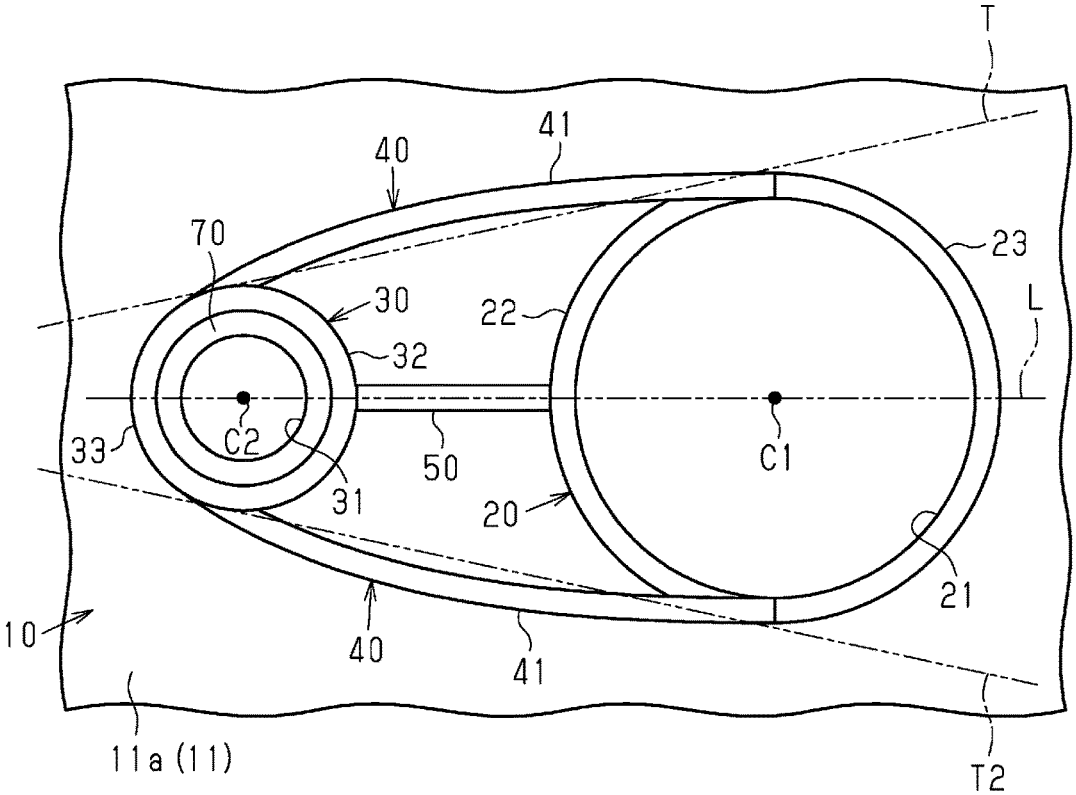
FIG. 2 is a bottom view of the embodiment, mainly illustrating a first tubular portion, a second tubular portion, and ribs.
Figure 3:
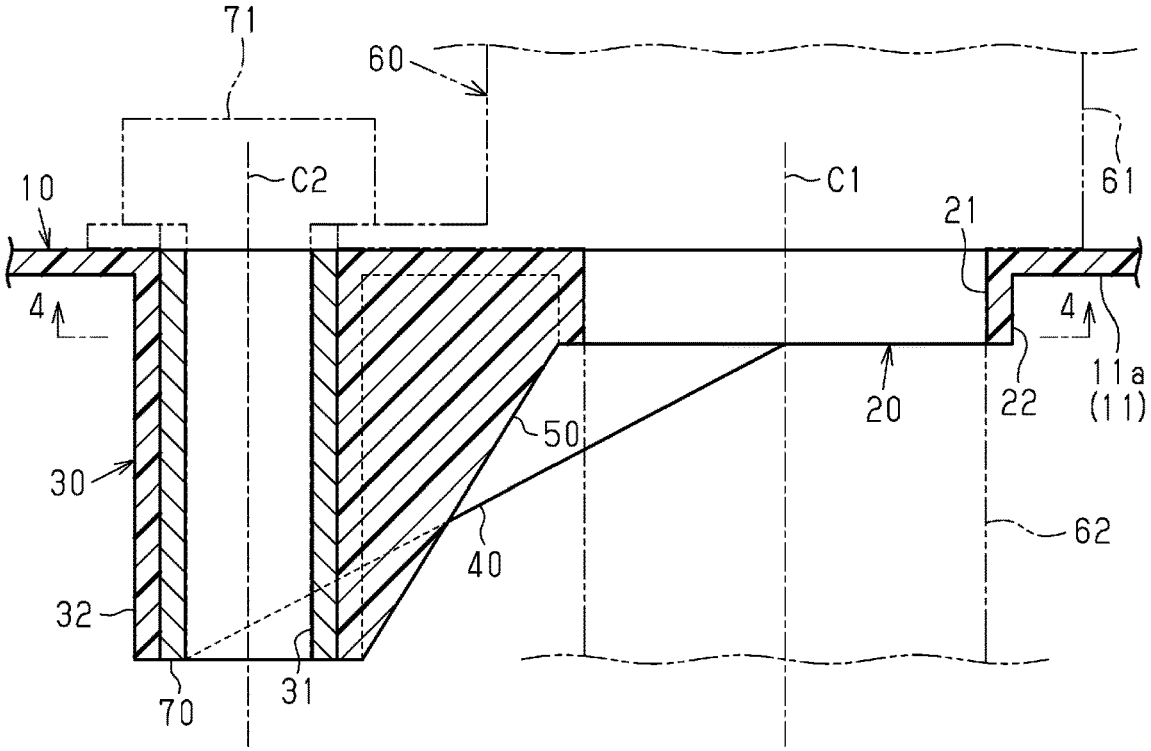
FIG. 3 is a cross-sectional view taken along line 3-3 of FIG. 1.

The top wall 11 includes a back face 11*a*, which corresponds to the main surface of the base according to the present disclosure (refer to FIGS. 2 and 3).

As shown in FIGS. 2 and 3, the top wall 11 includes first tubular portions 20 and second tubular portions 30, which are cylindrical and protrude from the back face 11*a*.

The present embodiment includes four first tubular portions 20 and four second tubular portions 30.

Each first tubular portion 20 defines an insertion hole 21, into which an insertion portion 62 of an ignition coil 60 is inserted.

The inner diameter of the second tubular portions 30 is smaller than the inner diameter of the first tubular portions 20. The protruding amount of each second tubular portion 30 from the back face 11*a* of the top wall 11 is greater than the protruding amount of each first tubular portion 20 from the back face 11*a*.

Each second tubular portion 30 includes a nut 70, which is embedded by insert molding. Each second tubular portion 30 defines a fastening hole 31. A bolt 71 for fixing a case 61 of the corresponding ignition coil 60 to the cylinder head cover 10 is fastened to each fastening hole 31.

Each bolt 71 corresponds to the fastening member according to the present disclosure.

<First Ribs 40>

Figure 4:
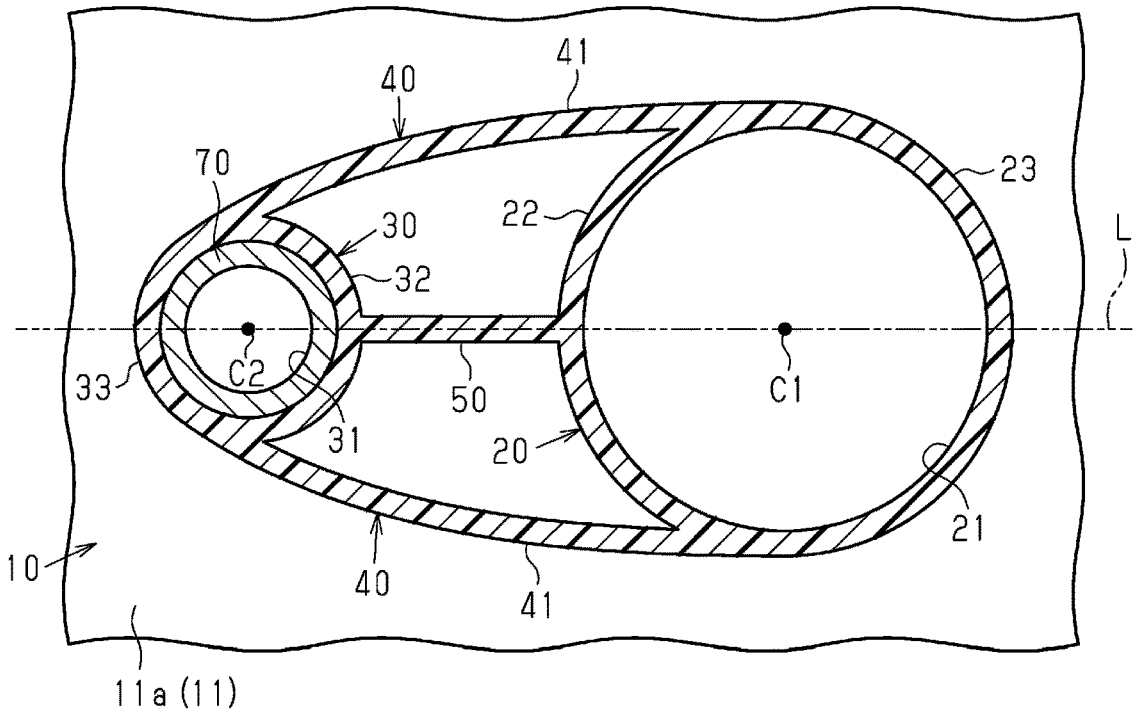
FIG. 4 is a cross-sectional view taken along line 4-4 of FIG. 3.

The cylinder head cover 10 includes four pairs of first ribs 40, which protrude from the back face 11*a* of the top wall 11 as shown in FIGS. 2 to 4. For the illustrative purposes, the following describes one of the four pairs of first ribs 40 and the related structures. The pair of first ribs 40 connects an outer circumferential surface 22 of the first tubular portion 20 to an outer circumferential surface 32 of the second tubular portion 30.

As shown in FIGS. 2 to 4, the two first ribs 40 are located on the opposite sides of an imaginary plane L, which includes a central axis C1 of the first tubular portion 20 and a central axis C2 of the second tubular portion 30.

As shown in FIG. 2, the two first ribs 40 extend arcuately at positions outward of a pair of external common tangents T of the outer circumferential surface 22 of the first tubular portion 20 and the outer circumferential surface 32 of the second tubular portion 30. Outer surfaces 41 of the pair of first ribs 40, a part 23 of the outer circumferential surface 22 of the first tubular portion 20, and a part 33 of the outer circumferential surface 32 of the second tubular portion 30 form an annular shape. That is, the two first ribs 40 have a symmetrical shape with respect to the imaginary plane L, which includes the central axis C1 of the first tubular portion 20 and the central axis C2 of the second tubular portion 30.

As shown in FIG. 3, the protruding amount of each first rib 40 from the back face 11*a* of the top wall 11 increases from the first tubular portion 20 toward the second tubular portion 30.

<Second Rib 50>

The cylinder head cover 10 includes four second ribs 50, which protrude from the back face 11*a* of the top wall 11 as shown in FIGS. 2 to 4. For the illustrative purposes, the following describes one of the four second ribs 50 and the related structures. The second rib 50 is located between the two first ribs 40 and connects the outer circumferential surface 22 of the first tubular portion 20 and the outer circumferential surface 32 of the second tubular portion 30 to each other.

As shown in FIGS. 2 and 4, the second rib 50 extends along the imaginary plane L. More specifically, the second rib 50 is disposed on the imaginary plane L.

The protruding amount of the second rib 50 from the back face 11*a* of the top wall 11 increases from the first tubular portion 20 toward the second tubular portion 30.

An operation of the present embodiment will now be described.

When molding shrinkage occurs, the force pulling the second tubular portion 30 toward the first tubular portion 20 is dispersed by the pair of first ribs 40 and the second rib 50. The second tubular portion 30 is therefore prevented from being pulled toward the first tubular portion 20. Particularly, the two first ribs 40 are located on the opposite sides of the imaginary plane L, which includes the central axis C1 of the first tubular portion 20 and the central axis C2 of the second tubular portion 30. Thus, the second tubular portion 30 is prevented from collapsing toward one of the two first ribs 40 also from collapsing toward the other first rib 40.

The present embodiment has the following advantages.

(1) The cylinder head cover 10 includes the pairs of first ribs 40. Each pair of first ribs 40 protrudes from the back face 11*a* and connects the outer circumferential surface 22 of the corresponding first tubular portion 20 and the outer circumferential surface 32 of the corresponding second tubular portion 30 to each other. The two first ribs 40 are located on the opposite sides of the imaginary plane L, which includes the central axis C1 of the first tubular portion 20 and the central axis C2 of the second tubular portion 30.

This configuration operates in the above described manner and thus improves the dimensional accuracy of the cylinder head cover 10.

Also, the above-described configuration reduces the increase in the size of the cylinder head cover 10 as compared to a case in which ribs are disposed to extend radially from the outer circumferential surface 32 of the second tubular portion 30.

This improves the dimensional accuracy in a favorable manner.

(2) The protruding amount of the first ribs 40 from the back face 11*a* increases from the first tubular portion 20 toward the second tubular portion 30.

A section of each first rib 40 that is close to the first tubular portion 20 receives a pulling force toward the first tubular portion 20 due to the molding shrinkage of the first tubular portion 20. On the other hand, a section of each first rib 40 that is close to the second tubular portion 30 receives a pulling force toward the second tubular portion 30 due to the molding shrinkage of the second tubular portion 30.

In the above-described configuration, the protruding amount of each first rib 40 from the back face 11*a* increases toward the second tubular portion 30. Thus, the protruding amount of the section of each first rib 40 that is close to the second tubular portion 30 is greater than the protruding amount of the section close to the first tubular portion 20. This increases the pulling force toward the second tubular portion 30 effectively in the first rib 40. Accordingly, the second tubular portion 30 is prevented from being pulled toward the first tubular portion 20 due to molding shrinkage more effectively.

(3) The two first ribs 40 have a symmetrical shape with respect to the imaginary plane L, which includes the central axis C1 of the first tubular portion 20 and the central axis C2 of the second tubular portion 30.

This configuration prevents the second tubular portion 30 from collapsing toward one of the two first ribs 40, and prevents the second tubular portion 30 from collapsing toward the other first rib 40 effectively. This further improves the dimensional accuracy of the cylinder head cover 10.

(4) The two first ribs 40 extend arcuately at positions outward of the pair of external common tangents T of the outer circumferential surface 22 of the first tubular portion 20 and the outer circumferential surface 32 of the second tubular portion 30.

This configuration disperses the pulling force that acts on the pair of first ribs 40 due to molding shrinkage in a favorable manner. Accordingly, the second tubular portion 30 is prevented from being pulled toward the first tubular portion 20 due to molding shrinkage effectively.

In the above-described configuration, the outer surfaces 41 of the pair of first ribs 40, the part 23 of the outer circumferential surface 22 of the first tubular portion 20, and the part 33 of the outer circumferential surface 32 of the second tubular portion 30 form an annular shape. This increases the stiffness of the entire cylinder head cover 10.

(5) The cylinder head cover 10 includes the second ribs 50, each of which protrudes from the back face 11*a* between the corresponding two first ribs 40. The second rib 50 connects the outer circumferential surface 22 of the first tubular portion 20 and the outer circumferential surface 32 of the second tubular portion 30 to each other. The second rib 50 is disposed on the imaginary plane L.

This configuration prevents the second tubular portion 30 from being pulled toward the first tubular portion 20 due to molding shrinkage more effectively. Particularly, since the second rib 50 is disposed on the imaginary plane L, the second tubular portion 30 is prevented from being pulled toward the first tubular portion 20 in a favorable manner. This further improves the dimensional accuracy of the cylinder head cover 10.

Also, since the second rib 50 is disposed between the two first ribs 40 in the above-described configuration, the second rib 50 does not increase the size of the cylinder head cover 10.

(6) Each second tubular portion 30 defines a fastening hole 31, to which the corresponding bolt 71 is fastened.

This improves the dimensional accuracy of the cylinder head cover 10, so that the bolt 71 is easily and properly fastened to the second tubular portion 30.

<Modifications>

The present embodiment may be modified as follows. The present embodiment and the following modifications can be combined as long as the combined modifications remain technically consistent with each other.

The number of the first tubular portions 20 and the number of the second tubular portions 30 are not limited to four. The number of the first tubular portions 20 and the number of the second tubular portions 30 can be changed in accordance with the number of cylinders of the internal combustion engine in which the cylinder head cover 10 is employed.

In place of the bolt 71, which fixes the ignition coil 60, a bolt that fixes a sensor mounted on the internal combustion engine may be fastened to the fastening hole 31 defined by the second tubular portion 30.

The second tubular portion 30 is not limited to a portion that defines a fastening hole to which a bolt is fastened, but may be a portion that defines a passage through which fluid flows.

The first tubular portion 20 is not limited to a portion that defines the insertion hole 21, into which the insertion portion 62 of the ignition coil 60 is inserted, as in the above-described embodiment, but may be a portion that defines an insertion hole into which another component is inserted. Also, the first tubular portion 20 does not necessarily need to define an insertion hole, into which a component is inserted, but may define a passage through which fluid flows.

The second rib 50 is not limited to be disposed along the imaginary plane L as in the above-described embodiment, but may intersect the imaginary plane L. Also, the protruding amount of the second rib 50 from the back face 11*a* of the top wall 11 may be changed. For example, the protruding amount may be constant between the first tubular portion 20 and the second tubular portion 30.

The second rib 50 may be omitted.

The shapes of the pair of first ribs 40 are not limited to the ones in the above-described embodiment, but may be shapes that extend along the external common tangents T and located on the external common tangents T. Also, the two first ribs 40 may be asymmetric with respect to the imaginary plane L. Also, the protruding amount of the first ribs 40 from the back face 11*a* of the top wall 11 may be changed. For example, the protruding amount may be constant between the first tubular portion 20 and the second tubular portion 30.

The plastic molded article is not limited to a cylinder head cover as in the above-described embodiment. That is, the present disclosure can be applied to any plastic molded article that includes a base, a first tubular portion, and a second tubular portion, and in which the base has a main surface, the first tubular portion protrudes from the main surface, the second tubular portion has an inner diameter smaller than that of the first tubular portion, and the base, the first tubular portion, and the second tubular portion are integrally molded of plastic.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A plastic molded article, comprising: a base having a main surface; a first tubular portion protruding from the main surface; a second tubular portion protruding from the main surface and having an inner diameter smaller than that of the first tubular portion; and a pair of ribs that protrudes from the main surface, each of the ribs connecting an outer circumferential surface of the first tubular portion and an outer circumferential surface of the second tubular portion to each other, wherein the base, the first tubular portion, the second tubular portion, the ribs are integrally molded of plastic, and the ribs are located on opposite sides of an imaginary plane that includes a central axis of the first tubular portion and a central axis of the second tubular portion, wherein the plastic molded article is a cylinder head cover that is configured to be attached to a cylinder head of an internal combustion engine, the first tubular portion defines an insertion hole, into which an insertion portion of an ignition coil is inserted, and the second tubular portion defines a fastening hole, to which a bolt for fixing the ignition coil to the cylinder head cover is fastened.

2. The plastic molded article according to claim 1, wherein a protruding amount of the ribs from the main surface increases from the first tubular portion toward the second tubular portion.

3. The plastic molded article according to claim 1, wherein the ribs have symmetrical shapes with respect to the imaginary plane.

4. The plastic molded article according to claim 1, wherein the ribs extend arcuately at positions outward of a pair of external common tangents of the outer circumferential surface of the first tubular portion and the outer circumferential surface of the second tubular portion.

5. The plastic molded article according to claim 1, wherein the ribs are first ribs, the plastic molded article further comprises a second rib that protrudes from the main surface between the first ribs, and the second rib connects the outer circumferential surface of the first tubular portion and the outer circumferential surface of the second tubular portion to each other.

6. The plastic molded article according to claim 1, wherein the second tubular portion defines a fastening hole, to which a fastening member is fastened.

7. The plastic molded article according to claim 1, comprising a plurality of first tubular portions, and for each of the plurality of first tubular portions a corresponding second tubular portion.

* * * * *